United States Patent [19]

Mahoney

[11] Patent Number: 4,727,618

[45] Date of Patent: Mar. 1, 1988

[54] ADJUSTABLE HANDLE ON A HAND IMPLEMENT

[76] Inventor: Frederick G. Mahoney, 212 9th St., Pittsburgh, Pa. 15222

[21] Appl. No.: 664,999

[22] Filed: Oct. 26, 1984

[51] Int. Cl.[4] ..... A46B 9/10

[52] U.S. Cl. ..... 15/172; 15/144 R; 15/176; 403/90; 403/103

[58] Field of Search ..... 15/172, 176, 144 R144 A, 15/145, DIG. 4, 194; 403/90, 103, 114, 115

[56] References Cited

U.S. PATENT DOCUMENTS

| | | | |
|---|---|---|---|
| D. 117,933 | 12/1939 | Manchester et al. | 15/111 X |
| 2,490,159 | 12/1949 | Ricchiuti | 15/194 X |
| 2,617,663 | 11/1952 | Carlton | 403/90 |
| 2,874,399 | 2/1959 | Friedman | 15/DIG. 4 |
| 2,887,710 | 5/1959 | Mahoney | 15/172 |
| 3,340,557 | 9/1967 | Rosenzweig | 15/176 |
| 4,494,268 | 1/1985 | Chu | 15/176 |

FOREIGN PATENT DOCUMENTS

| | | | |
|---|---|---|---|
| 2428418 | 2/1980 | France | 15/176 |

*Primary Examiner*—Peter Feldman

*Attorney, Agent, or Firm*—Carothers & Carothers

[57] ABSTRACT

A hand implement having an adjustable handle which is selectively movable by operation of improved retention means therefor to any of a variety of use positions, each of which corresponds to a handle position perpendicular to one of a plurality of abutment faces located in non-parallel planes, and a reversable tool head in such a hand implement to selectively provide, for each handle position, either right hand or left hand tool orientation.

7 Claims, 3 Drawing Figures

ADJUSTABLE HANDLE ON A HAND IMPLEMENT

This invention relates generally to holders for hand implements such as paint brushes and more particularly to a hand implement holder that provides for the positioning of the implement handle at different angles relative to the implement.

The problem of providing the holder of a hand implement with a handle that may be positioned at different relative angles may be solved by providing a plurality of angularly disposed faces on the holder, each face having a threaded hole or socket that is generally plugged with a screw when not in use. When the screw is removed, the threaded stem on the implement handle is secured in the socket. This structure fulfills the purpose of disposing the handle at different relative angles to the implement, but the holes or threaded sockets may become plugged if the plug screws are not inserted and the holes may become clogged and unusueable thus defeating the purpose of the multiangle holder.

It has also been suggested to provide a ball and socket arrangement wherein the implement handle member may be shifted through a slot and secured at one of several angular positions.

Prior U.S. Pat. No. 2,887,710 of the inventor herein discloses an implement holder provided with a plurality of flat faces connected by slots. A handle is attached to a stem which is pivotally secured within the holder so that it may swing within any one of the selected slots on the holder and be secured rigidly adjacent a respective flat clamp face. In the disclosure of the cited patent, to shift the handle to a different relative position it is necessary to loosen the handle in order to permit it to clear the perimeter of the flat face and pass to an adjacent face while it is still attached to the stem. This is accomplished by employing a pivotal or flexible joint on the inner end of the stem which permits the stem to be shifted angularly to any one of the slots in the flat clamping faces on the holder. The outer end of the stem may be threaded and the implement handle also threaded to receive the stem. This permits unscrewing or backing off the handle sufficiently to allow it to pass over the abutments formed by the margins of the flat clamping faces. When the stem is placed in its new position the handle may be screwed tight until it engages the face and is locked in a position on that face. Thus, the single stem may be adjusted to any of number of faces on the holder by connecting the slots of each face to the central position where the inner end of the stem is pivoted to the holder.

The present invention comprises in one aspect an improvement over the prior art structures wherein the pivotal connection by which the handle stem is pivotally retained with respect to the implement holder includes an oblong retention ball member having its major axis oriented preferably at an angle of 90° to the axis of the stem and the attached implement handle. In another aspect of the invention, the implement is a non-symmetrical structure such as a trim paint brush having bristle ends which are trimmed to form an angle to the base or holder. The implement head is selectively detachable from the holder for selective reversal or replacement thereof whereby, for any handle position, the implement head may be affixed to the holder for either right-hand or left-hand use, or if worn out, may be replaced with a new implement head.

The clamping face on the head may be in the form of a frustrum of a pyramid which provides three to six or more side or lateral faces and a top face. Each of the lateral clamping faces is preferably set at a different angle than the adjacent or opposing clamping face so as to provide for different angular positions of the handle relative to the implement. Each clamp face is preferably flat and the perimeral edge thereof forms an abutment which requires the handle to be loosened, to the extent that it is not usable as a handle for the tool, before it can be shifted to another clamp face.

This adjustable handle for an implement does not become inoperative because of paint, dirt or other debris that ordinarily fills up a threaded socket. If the slots that hold the stem become filled with paint they may be readily cleaned out to restore the adjustable handle feature of the implement.

It is therefore one object of this invention to provide an improved adjustable handle implement.

Another object of the invention is to provide an adjustable implement wherein the implement and the handle may be selectively adjusted with respect to a common base whereby various unique handle positions may be employed for either right hand or left hand use.

Another object of the invention is to provide an implement such as a paint brush with a replaceable bristle head.

These and other objects and further advantages of the invention will be more readily understood upon consideration of the following detailed description and the accompanying drawings wherein.

Figure 1:
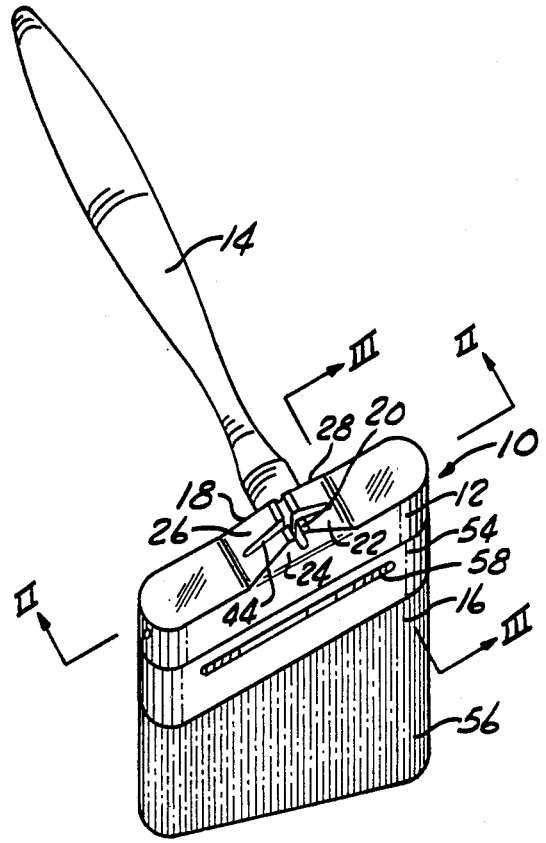
FIG. 1 is a perspective view of an implement holder of the present invention.
Figure 2:
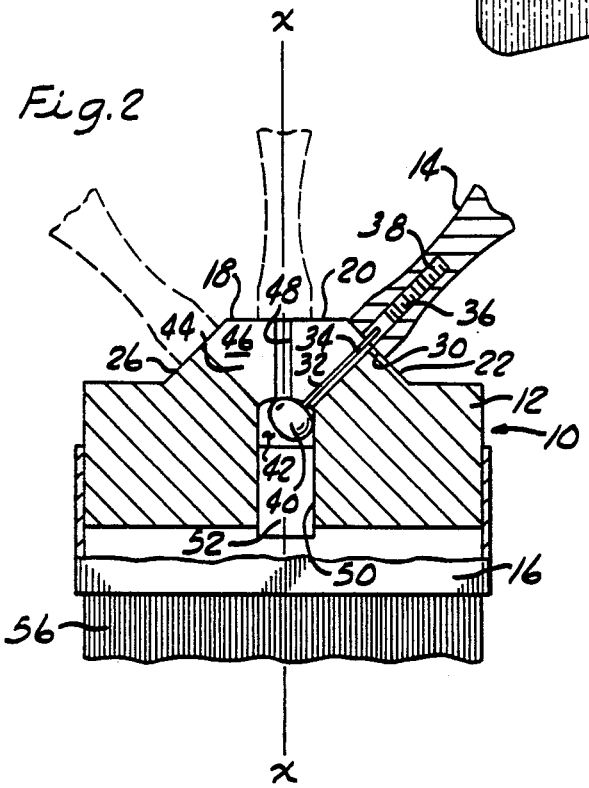
FIG. 2 is a fragmentary sectional view taken on Line II—II of FIG. 1.

There is generally indicated at 10 in FIGS. 1 and 2 an implement in the form of a paint brush having a base portion 12 to which are adjustably affixed a handle 14 and a head 16. For ease of manufacture, base 12 may be a molded plastic component, for example.

Implement 10 is provided with a handle connection portion 18 located centrally atop base 12. Connection portion 18 may take the form of a frustrum of a pyramid having a top planar surface 20 which is perpendicular to axis X—X of the implement 10 (FIG. 2), and a plurality of planar flank surfaces 22, 24, 26, and 28, each of which may be disposed at a different angle with respect to axis X—X. In particular, one such side surface, such as surface 28 for example, may be parallel to axis X—X. The surfaces 20, 22, 24, 26, and 28 provide engagement surfaces against which the butt end surface 20 of handle 14 may be engaged by a clamping mechanism as described hereinbelow to dispose the handle 14 selectively at any of a variety of relative angular positions with respect to axis X—X, as shown in FIG. 2.

In order to secure handle 14 with respect to base 12, a connector 32 is provided. Connector 32 comprises an elongated stem 34 having a threaded end portion 36 which is received in threaded engagement within an axial blind bore 38 formed in the butt end 30 of handle 14. To the opposite end of stem 34 is rigidly affixed a pivot ball member 40 having an oblong form somewhat akin to the shape of a football and oriented with the major axis thereof perpendicular to the axis of stem 34.

Ball member 40 is received within a pocket 42 formed in base 12 generally subjacent connection portion 18 to provide a ball and socket joint. Stem portion 34 extends outwardly of base 12 through a cross slot opening 44 which extends between pocket 42 and the exterior of base 12 within connector portion 18. More specifically, cross slot opening 44 comprises a slot 46 which is disposed in a plane perpendicular to surfaces 26 and 22, and parallel to axis X—X. Similarly, a slot 48 extends in a plane which is perpendicular to faces 24 and 28 and to the plane of slot 46. Each slot 46 and 48 is cut to a sufficient depth such that, with ball 40 disposed in pocket 42, stem 34 may be pivoted to a perpendicular orientation with respect to any of faces 20, 22, 24, 26, or 28. Accordingly, handle 14 may be secured to stem portion 36 in a manner that, by selectively adjusting handle 14 on stem 34 the handle butt end surface 30 may selectively engage or disengage any of faces 20, 22, 24, 26, or 28 to thereby assume any of a variety of angular positions with respect to base 12. When handle 14 is tightly engaged, butt end surface 30 contacts one of the described faces 20, 22, 24, 26, and 28, and ball 40 is pulled upward into engagement with the upper surface portion or terminus of pocket 42, and stem 34 is maintained in tension therebetween.

The perimetral surface of each face 20, 22, 24, 26, and 28 form abutments which prevent handle 14, when tightly engaged on a given face, from shifting from a perpendicular position with respect to that face. Thus, a rigid yet readily adjustable implement holder structure is provided.

For assembly of the above-described structure, the connector 32 is inserted, threaded end first, into a passage 50 which extends from the bottom of base 12 to pocket 42. A plug 52 is then inserted and secured in passage 50 to retain ball 40 in pocket 42 with stem 34 extending outward of connector portion 18 through cross slot opening 44.

It is noted that pocket 42 is formed to preclude rotation of ball 40 therein about the axis of stem 34 whereby the handle 14 may be readily tightened or loosened on threads 36 while the connector 32 is secured against rotation. However, for the position of handle 14 at a right angle to axis X—X as shown in FIG. 1 (i.e. handle butt end surface 30 in engagement with face 28) ball 40 could rotate with handle 14 within pocket 42 thereby complicating handle adjustment. To preclude this, plug 52 extends far enough into passage 50 that the clearance between plug 52 and the top of pocket 42 is insufficient to permit ball 40 to rotate with handle 14 in the FIG. 1 position. That is, the length of oblong ball 40 along its major axis is greater than the minimum clearance between the top of pocket 42 and plug 52.

Figure 3:
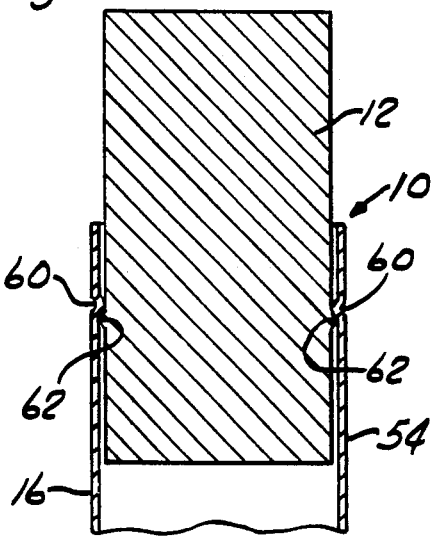
FIG. 3 is a fragementary sectional view taken on line III—III of FIG. 1.

As shown in FIG. 1, brush head 16 comprises a sheath portion 54 which has a bundle of bristles 56 secured in one open end thereof and receives base 12 into the opposite open end thereof. The ends of bristles 56 preferably may be cut at an angle to the axis X—X rather than perpendicular thereto, although in general this is merely exemplary of implements of a nature which permit distinct implement configurations by selective reversal of the implement head 16 on base 12. Accordingly, sheath 54 may be provided with inwardly projecting ridges 58 (FIG. 1) or dimples 60 (FIG. 3) which cooperate with suitably formed retention structures 62 formed on baase 12 to releasably retain the head 16 thereon.

The dimples 60 or ridges 58 therefore may override retention structures 62 for retention or release of head 16, and the head 16 thus may be reversed at will.

One benefit of this feature, in conjunction with the adjustability of handle 14, is that for any position of handle 14 the implement may be utilized as either a left hand or right hand oriented tool. In the exemplary embodiment, the handle 14 may be set at any of a plurality of positions, and for each available position the head 16 may be installed with the ends of bristles 56 angled for trim paint application in either of opposite directions.

Another benefit of the interchangeable bristle head structure is that the bristle head may be replaced by another like or different bristle head to facilitate extended paint brush life and versatility.

According to the description hereinabove the present invention provides an improved adjustable handle implement in which both a handle portion and a tool head portion are independently adjustable with respect to a common base whereby highly diverse tool configurations are possible. Furthermore, the invention contemplates an improved adjustment and retention structure for a multiposition tool handle and a replaceable implement head structure.

Although the invention has been described with reference to a presently preferred embodiment thereof, it will be appreciated that the invention may be practiced in various alternative and modified embodiments without departing from the broad spirit and scope thereof. Accordingly, it is intended that the invention be construed broadly in accordance with the scope of the claims appended hereto.

I claim:

1. In a hand implement assembly comprised of an implement and a handle mounted on a common base wherein the handle is secured and adjustable with respect to the base by a selectively releasable retention means which is operable to selectively retain the butt end of the handle in firm abutting engagement with any of a plurality of faces which are oriented at differing angles to a longitudinal axis of the implement base and head and wherein the pluarlity of faces include a flat top surface which is oriented transverse to the said longitudinal axis and a plurality of flat flank surfaces which diverge outwardly from said top surface to said base at various angles relative to said top surface to define a plurality of handle positions such that for any of said handle positions the retention means traverses the respective said face within a respective slot structure which communicates with the others of said faces to provide for selective movement of the handle and connected retention means to any said handle position corresponding to a given face, the improved retention means comprising:

an elongated stem having rotary securing means adjacent one end thereof for securing said handle thereto and for selective adjustment of the longitudinal position of said handle axially of said stem by axial rotation of said handle;

oblong ball means rigidly secured adjacent the opposite end of said stem with the major axis thereof oriented generally transverse to the axis of said stem;

pocket means formed in said base to cooperably receive said ball means therein to form a ball and socket pivot joint; and said pocket means being of such cross sectional form that said ball means is constrained against rotation about the axis of said stem whereby said retention means is constrained against axial rotation to permit axial rotary adjustment of the handle with respect thereto during securing or releasing of the handle with respect to any of said plurality of handle positions.

2. The improvement as claimed in claim 1 wherein said rotary securing means includes screw threads formed adjacent said one end to cooperate with complementary threads formed within a bore extending axially from said butt end of said handle.

3. The improvement as claimed in claim 2 wherein said pocket is defined in part by an end portion of a passage formed in said base to receive said ball means.

4. The improvement as claimed in claim 3 wherein said pocket is further defined by the upper end of a plug member which is received into said passage such that an end portion of said plug is spaced a predetermined distance from the terminals of said passage end portion.

5. A hand implement comprising:

a base member a tool head carried by said base member by retention means which permits said tool head to be retained by said base member in at least a pair of use positions;

said base member including a handle mounting portion comprised of a plurality of planar abutment surfaces residing in a respective plurality of non-parallel planes;

said retention means comprising an elongated handle securing means cooperable with said base member and said handle for selective retention of said handle in any of a plurality of positions, each of which corresponds to an orientation of said handle perpendicular to one of said abutment surfaces;

said securing means including an elongated stem and an oblong ball member affixed to said stem with its major axis oriented transverse to the axis of said stem such that said oblong ball cooperates with said base member to form a ball and socket pivot joint wherein said securing means is constrained by said base member against axial rotation; and said securing means further including rotary means for securing said handle thereto and for selective adjustment of the longitudinal position of said handle axially of said securing means by axial rotation of said handle with respect to said securing means.

6. The hand implement as claimed in claim 5 wherein said rotary means includes complementary screw threads.

7. The hand implement as claimed in claim 6 wherein said tool head comprises a trim brush for application of paint.

* * * * *